US006752157B2

(12) United States Patent
Lu Shao Hua

(10) Patent No.: US 6,752,157 B2
(45) Date of Patent: Jun. 22, 2004

(54) HAIR TREATMENT APPLICATOR AND APPLICATOR HEAD

(75) Inventor: Michael Lu Shao Hua, Hong Kong (HK)

(73) Assignee: Wah Wong Electric Manufactory Co., Ltd.

( * ) Notice: Subject to any disclaimer, the term of this patent is extended or adjusted under 35 U.S.C. 154(b) by 166 days.

(21) Appl. No.: 10/044,626

(22) Filed: Jan. 11, 2002

(65) Prior Publication Data

US 2003/0131864 A1 Jul. 17, 2003

(51) Int. Cl.[7] ..... A45D 24/16; A45D 24/22
(52) U.S. Cl. ..... 132/109; 132/116
(58) Field of Search ..... 132/108, 109, 132/110, 221, 112, 116, 117, 118; 401/265, 9, 10, 175, 183, 184, 185

(56) References Cited

U.S. PATENT DOCUMENTS 2,463,611 A * 3/1949 Green et al. ..... 132/108
2,603,223 A * 7/1952 Jefferson ..... 132/108
2,705,499 A * 4/1955 Breeze ..... 132/109
2,761,459 A * 9/1956 Kaul ..... 132/109
4,516,591 A * 5/1985 Hierholzer ..... 132/116
4,830,030 A * 5/1989 Busch et al. ..... 132/212
5,706,839 A * 1/1998 Patti ..... 132/277
6,022,163 A * 2/2000 Asfur ..... 401/175
6,062,231 A * 5/2000 De Laforcade ..... 132/145

* cited by examiner

*Primary Examiner*—Kevin Shaver
*Assistant Examiner*—Stephanie Willatt
(74) *Attorney, Agent, or Firm*—Jackson Walker LLP

(57) ABSTRACT

A hair treatment applicator head includes first and second elongate body members. That first body member has a handle portion at a first end and a first treatment surface proximate a second end. The treatment surface bearing a fluid absorbent material. The second body member has a flange for engagement with a treatment fluid supply at a first end and a second treatment surface proximate a second end. A fluid path extends through the body from proximate the flange to a plurality of apertures on the second treatment surface. The first and second elements are hingeably engaged to allow the first and second treatment surfaces to be brought into proximity each other.

8 Claims, 7 Drawing Sheets

HAIR TREATMENT APPLICATOR AND APPLICATOR HEAD

FIELD OF THE INVENTION

The invention relates to hair treatment applicators, and in particular to the application head for hair treatment applicators. Such hair treatments include coloring dyes, bleaches, conditioners and like fluids.

BACKGROUND TO THE INVENTION

Applicator combs for the continuous application of a fluid to the hair or scalp of humans and animals are known. Such devices comprise a reservoir for the fluid to be dispensed and a comb head and fluid communication with the reservoir. The comb head has a passage through which the fluid can pass, and a plurality of apertures in the area of the comb teeth. During the combing fluid is force from the reservoir through the passage and apertures and into the hair. The comb distributes the fluid through the hair strands.

The problem with known devices is that they give poor distribution of the fluid through the hair. The comb must be passed through the same patch of hair several times in order to ensure even distribution as the hair strand only contacts one surface of the comb at a time.

SUMMARY OF THE INVENTION

It is an object of the present invention to provides a hair treatment applicator and applicator head which overcomes or ameliorates the above disadvantage, or at least to provide the public with a useful alternative.

According to a first aspect of the invention there is provided a hair treatment applicator head including:

a first elongate body member having a handle portion at a first end and a first treatment surface proximate a second end, the treatment surface bearing a fluid absorbent material, and a second elongate body member having a flange for engagement with a treatment fluid supply at a first end and a second treatment surface proximate a second end, and a fluid path extending through the body from proximate the flange to a plurality of apertures on the second treatment surface, the first and second elements hingeably engaged to allow the first and second treatment surfaces to he brought into proximity each other.

According to a second aspect of the invention there is provided a hair treatment applicator including:

an elongate housing, a tubular element removably located within the housing and serving as a reservoir for hair treatment fluid, a pumping member located at the first end of the housing and in communication with a first end of the tubular element, and a hair dye applicator head located at a second end of the housing and in communication a second end of the tubular element, the applicator head including:

a first elongate body member having a handle portion at a first end and a first treatment surface proximate a second end, the treatment surface bearing a fluid absorbent material, a second elongate body member having a flange for engagement with the elongate housing at a first end and a second treatment surface proximate a second end, and a fluid path in fluid communication with the second end of the tubular element and extending through the body to a plurality of apertures on the second treatment surface, the first and second elements hingeably engaged to allow the first and second treatment surfaces to be brought into proximity each other.

According to a third aspect of the invention there is provided a hair treatment applicator including:

a deformable container closed at a first end and having a neck portion at a second end, the neck portion having an aperture therein providing a fluid path to the interior of the container, and a hair dye applicator head including:

a first elongate body member having a handle portion at a first end and a first treatment surface proximate a second end, the treatment surface bearing a fluid absorbent material, a second elongate body member having a flange for engagement with the neck portion at a first end, a second treatment surface proximate a second end, and a passage extending through the body from the flange to a plurality of apertures on the second treatment surface, the first and second elements hingeably engaged to allow the first and second treatment surfaces to be brought into proximity each other.

Preferably, the fluid absorbent material is removably attached to the first treatment surface.

Preferably, the fist treatment surface is removably engaged to the second end of the first elongate body member, and the fluid absorbent material is removably attached to the first treatment surface.

Preferably, the second elongate body has a plurality of teeth adjacent the second treatment surface.

Preferably, the tubular element of the treatment applicator has a worm drive longitudinally therethrough an a plunger disposed on the worm drive, the pumping element being a motor adapted to turn the worm drive and cause the plunger to eject treatment fluid from the second end of the tubular element.

Further aspects of the invention will become apparent from the following description, which is given by way of example only.

BRIEF DESCRIPTION OF THE DRAWINGS

Embodiments of the invention will now be described by way of example only and with reference to the accompanying drawings in which.

DESCRIPTION OF THE PREFERRED EMBODIMENTS

Figure 1:
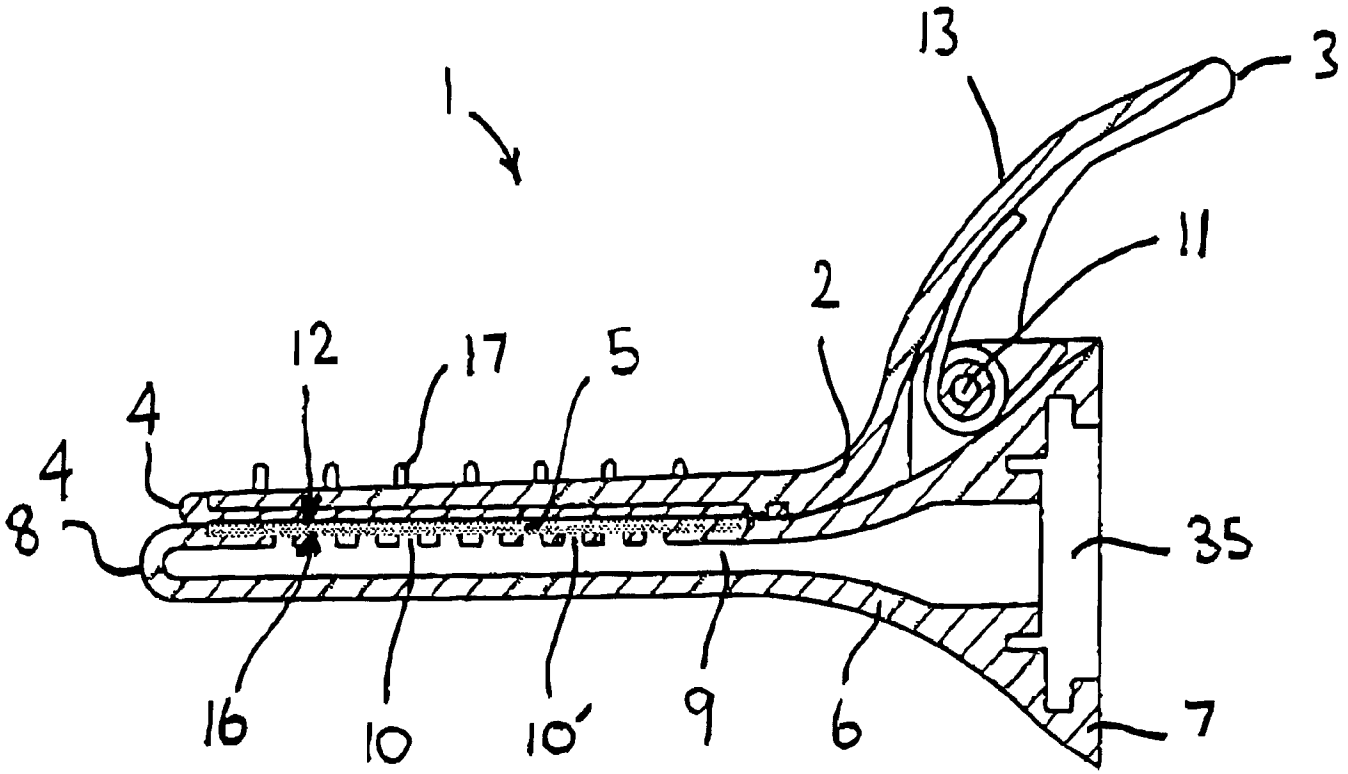
FIG. 1 illustrates a hair dye applicator head according to the invention.

Referring to FIG. 1, there shown is a hair treatment applicator head 1 according to the invention. The applicator head 1 comprises first and second elongate body member. The first elongate body member 2 has a handle 13 proximate its first end 3 and a first hair treatment surface 12 proximate its second end 4. The second elongate body member 6 has a flange at its first end 7 and a second hair treatment surface 16 proximate its second end 8. A fluid passage 9 extends through a second body members 2, 6 are hingeably engaged at a pivot point 11 so that the two treatment surfaces 12, 16 can be bought into proximity one another.

Figure 2:
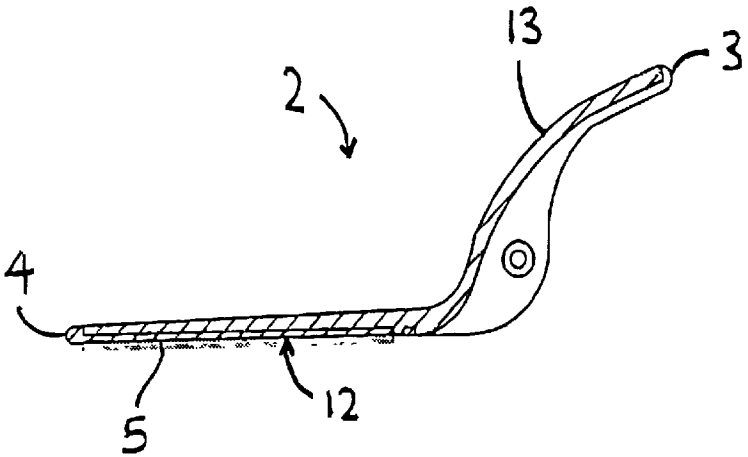
FIG. 2 illustrates an elevation view of a first body member of the applicator head.
Figure 3:
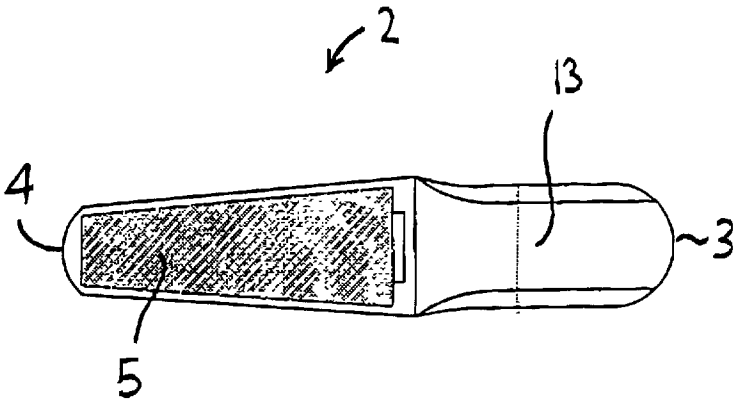
FIG. 3 illustrates a plan view of the first body member.

Referring to FIGS. 2 and 3, the first body member 2 of the applicator head 1 is shown in more detail. FIG. 2 is a side elevation view and FIG. 3 is a bottom plan view. The first treatment surface 12, on the underside of the first body member 2, bears a fluid absorbent material 5. This fluid absorbent material 5 can be of a fibrous or spongy nature. The fluid absorbent material 5 is removably attached to treatment surface 12, by adhesive, double-sided tape or like means. This allows the fluid absorbent material 5 to be replaced when its quality deteriorates.

Referring to FIGS. 4 through 7, the preferred embodiment of the invention wherein the first treatment surface 12 is removably disposed on first body element 12 is shown. The first treatment surface 12 is provided on the underside of a removable cartridge 14 which slidably engages over end 4 of the first body member 2. The fluid absorbent material 5 is removably attached to treatment surface 12 of cartridge 14. Cartridge 14 is removable for cleaning purposes.

Figure 6:
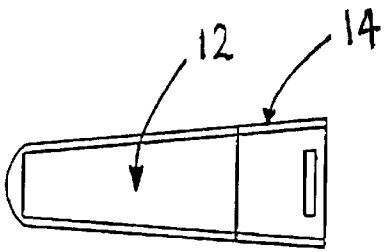
FIG. 6 illustrates a plan view of the second portion.
Figure 7:
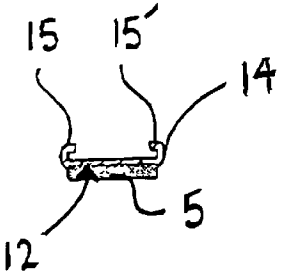
FIG. 7 illustrates an end view of the second portion.
Figure 4:
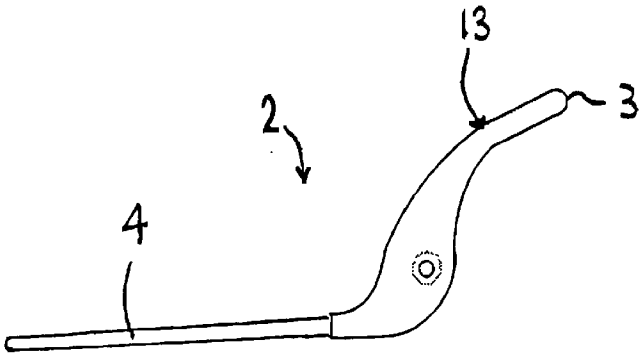
FIG. 4 illustrates a first potion of the first body member.
Figure 5:
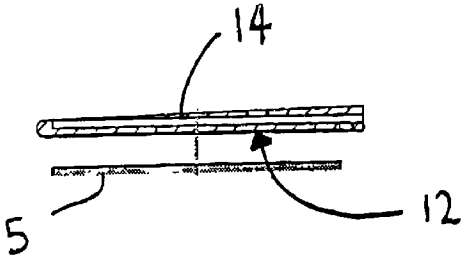
FIG. 5 illustrates a second portion of the first body member.

FIGS. 6, 6 and 7 illustrate cartridge 14. Both the second end 4 and cartridge 14 have a plan shape in the form of a frustum of a cone. The cartridge body extends upwardly and inwardly on both sides to form two inwardly facing "C" share lips 15. The cartridge 14 slidably engages over end 4 of first body member 2, with lips 15 engaging around the sides of end 4.

Figure 8:
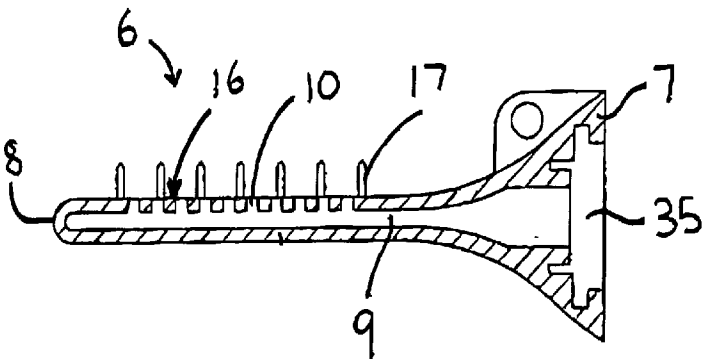
FIG. 8 illustrates an elevation view of a second body member of the applicator head.
Figure 9:
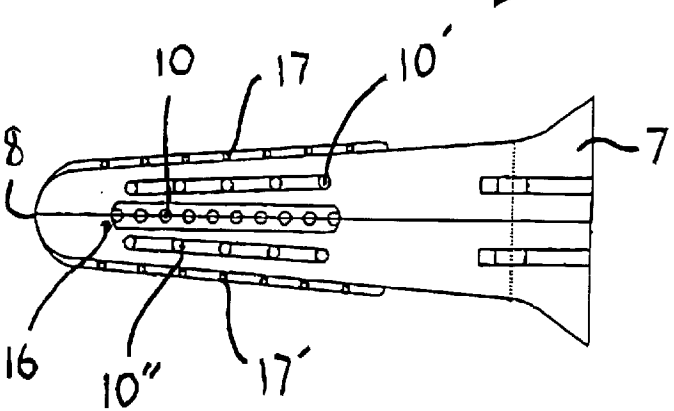
FIG. 9 illustrates a plan view of the second body member.

FIGS. 8 and 9 show the second body member 6 of the applicator head 1. Referring in particularly to the plan view of FIG. 9, the second body member 6 is substantially the same shape as the first element 2 in plan. The fluid passage 9 communicates with three rows of apertures 10 on the second treatment surface 16 on the top side of body member 6. Two rows of comb teeth 17 are provided proximate either side of second treatment surface 16. In use the first body member 2 lies in juxtaposition the second treatment surface 16 and between the two rows of teeth 17.

In use, strands of hair are disposed across second treatment surface 16 of second element 2. First body member 2 is pivotally moved to position first treatment surface 12 in juxtaposition second surface 16, sandwiching the strands of hair between the two treatment surfaces 12, 16. Hair treatment fluid passes through passage 9 and out of apertures 10, and some of the fluid is absorbed by absorbent material 5. When the hair is move between the two treatment surfaces treatment fluid is distributed on both side of the hair strands. The teeth 17 provide a combing effect to aid distribution of the treatment fluid.

Figure 10:
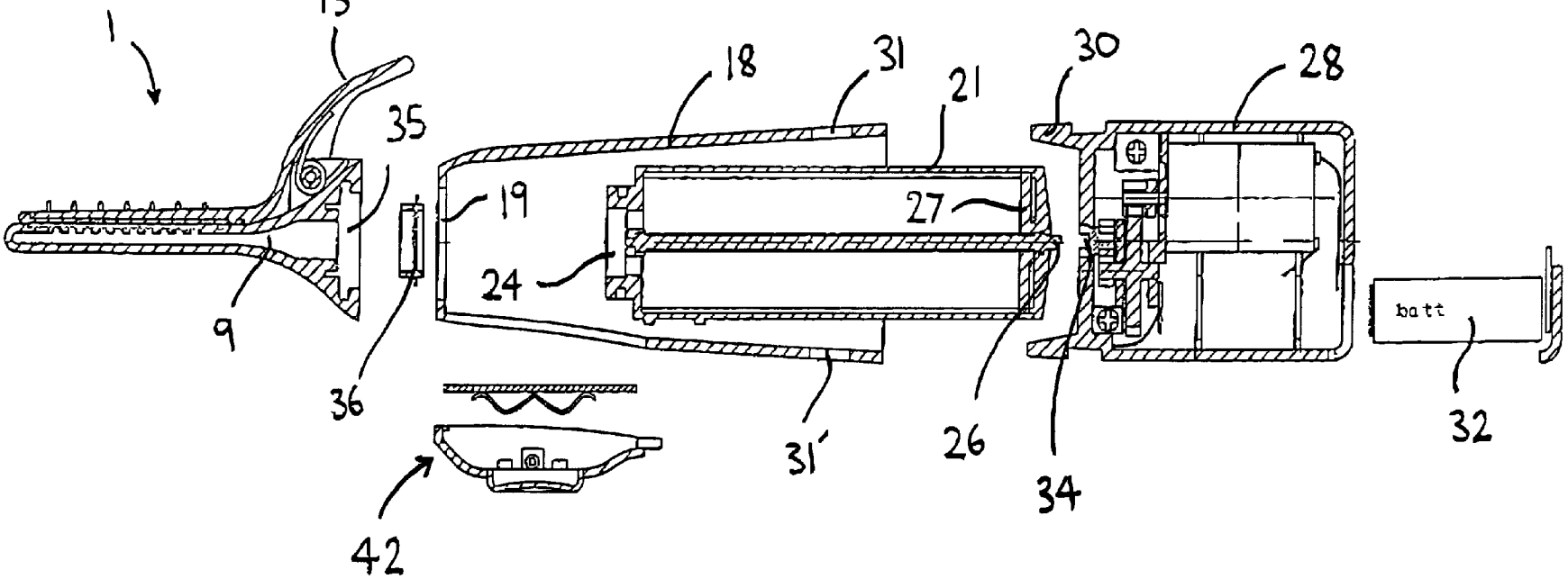
FIG. 10 illustrates a first hair treatment applicator employing the applicator head.

FIG. 10 illustrates a hair treatment applicator employing an applicator head according to the invention. The applicator comprises an elongate housing 18 with openings at its two ends 19, 20. The elongate housing 18 provides the gripping member for use of the applicator and can be shaped to fit comfortably in the palm of a hand.

Figure 13:
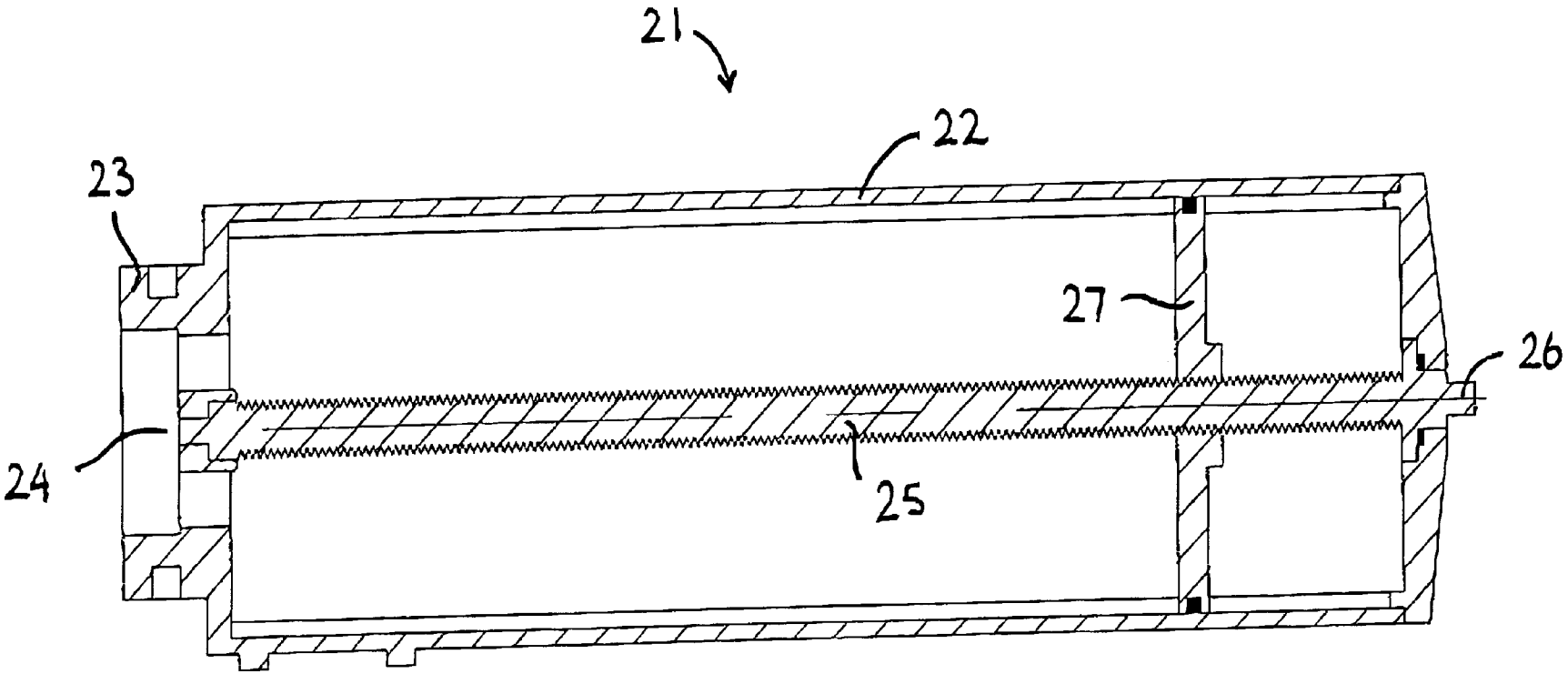
FIG. 13 illustrates a tubular hair treatment element for the hair dye applicator.

A tubular element 21 serves as a reservoir for treatment fluid and is removably locatable within housing 18. The tubular element 21 is shown in more detail in FIG. 13. It comprises a tubular cylinder 22 having a neck portion 23 at one end for engagement within opening 19 of housing 18. The neck portion 23 has an aperture 24 that provides a fluid passage to the interior of cylinder 22. The other end of cylinder 22 is closed. A worm gear 25 is disposed longitudinally along the axis of cylinder 22. The worm gear 25 extends through the close end of cylinder 22 and terminates in a drive coupling 26. A plunger 27 divides the interior of cylinder 22 and is dispose about the worm gear 25. The plunger 27 is keyed within the interior wall of cylinder 22 and moveably engaged with the thread on worm gear 25. Rotation of worm gear 25 causes plunger 27 to move longitudinally along cylinder 22.

Figure 11:
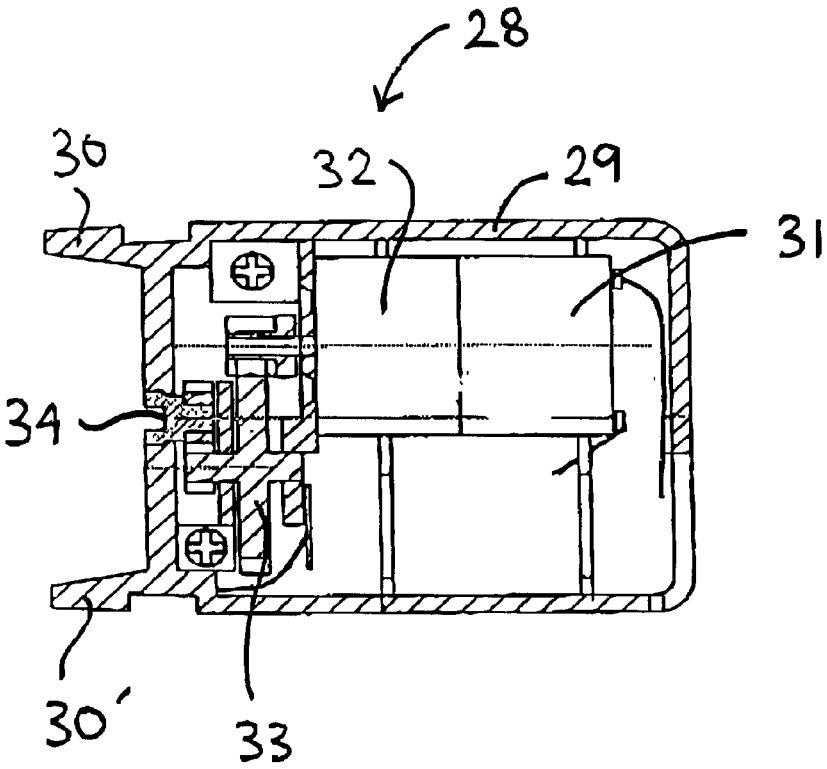
FIG. 11 illustrates a pumping motor for the hair treatment applicator.
Figure 12:
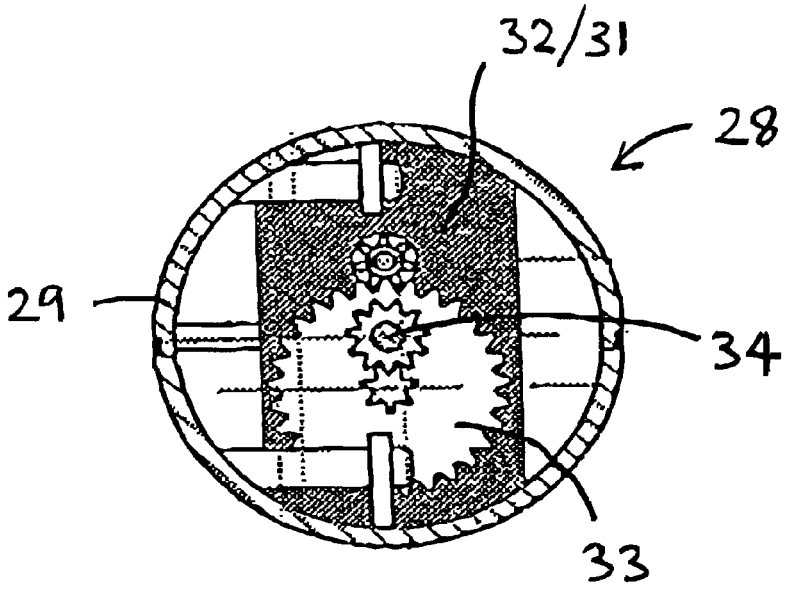
FIG. 12 illustrates an end view of the pumping motor.

Returning to FIG. 10, a pumping device 28 is dispose at end 20 of housing 18 and engages with driving coupling 26 of tubular element 21. The pumping element 27 is shown in more detail in FIGS. 11 and 12. The pumping device 28 comprises a housing 29 designed to be an extension of housing 18. The pumping housing 29 has clips 30 which engages with apertures 31 in housing 18 to secure it to end 20. Located within the housing 29 is an electric motor powered by battery 32. The motor has integral thereto a reduction gearbox 32 that drives a further reduction gear 33 and finally a drive coupling 34.

A switch mechanism 35, of known type, is provided external two housing 18 and located so as to be comfortable to operate with the thumb of a user holding the applicator by housing 18. The switch has three positions: forward, stop, and reverse. The forward position causes the electric motor 31 to rotate in a first direction thus turning the drive coupling 34, drive cupling 26 and causing plunger 27 to move in a first direction longitudinally along cartridge 22. In the reverse position the motor is caused to rotate in a second direction causing plunger 27 to move in the opposite direction longitudinally along cartridge 22. In use, by operation of the switch to the forward position the plunger 27 is caused to move towards aperture 24 of cartridges 22 thus ejecting treatment fluid in the cartridge from aperture 24.

A treatment application head 1, as previously described, is engage with first end 19 of housing 18. An adapter grommet 36 locates between aperture 35 of fluid passage 9 and aperture 24 of cartridge 22 to complete a fluid communication path there between. When treatment fluid is ejected from cartridge 22 by movement of plunger 27 it passes along fluid passage 9 and is ejected from apertures 10 on second treatment surface 16 and thus can be applied to hair.

Figure 14:
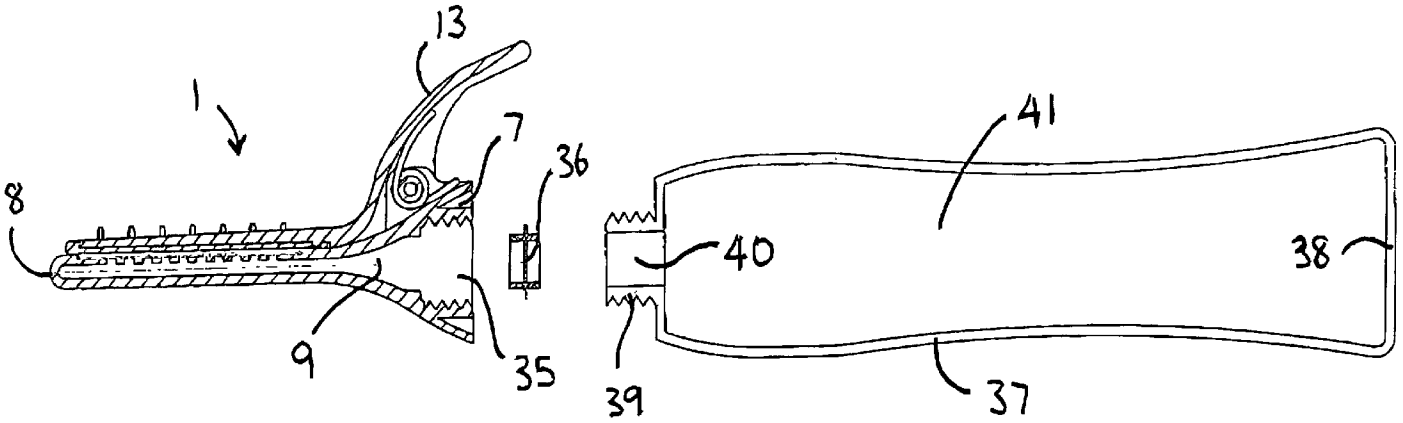
FIG. 14 illustrates a second hair treatment applicator employing the applicator head.
Figure 15:
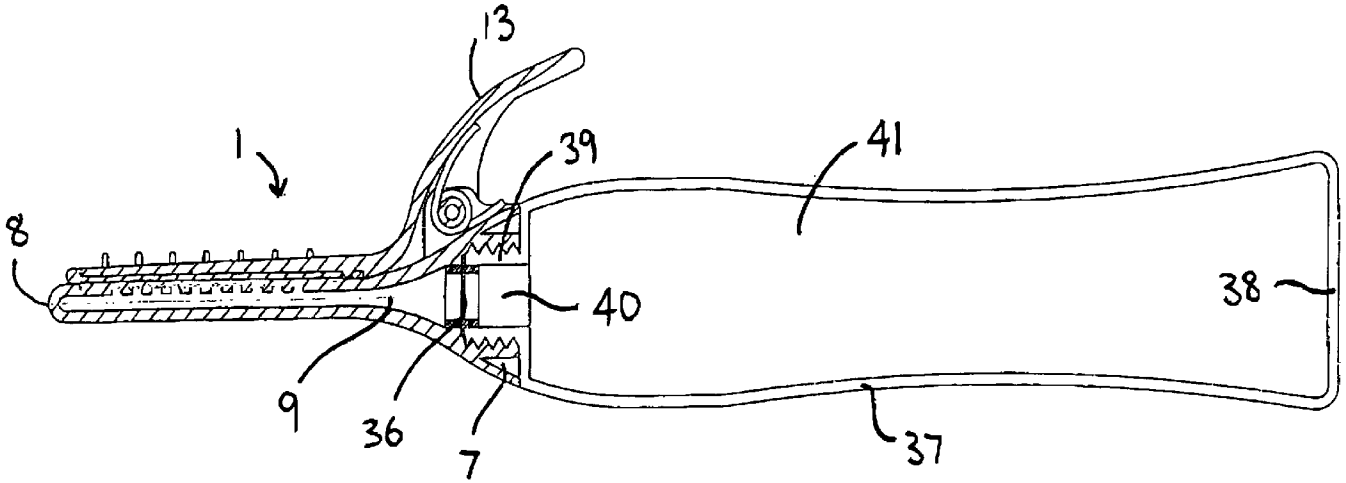
FIG. 15 illustrates the second hair treatment applicator.

A second embodiment of a hair treatment applicator employing a treatment head according to the invention is illustrated in FIGS. 14 and 15. The applicator comprises a container or tube 37 made from deformable material and being closed at its first end 38. A threaded neck portion 39 is provided at the second end of tube 37. An aperture 40 provides a fluid passage to the interior 41 of the tube 37. A hair treatment head 1 as previously described is engaged with the threaded neck portion 39 of tube 37. Aperture 35 of flange end 7 of head 1 has a thread provided therein to allow screw engagement.

Tube 37 provides a reservoir for hair treatment fluid. During operation tube 37 is deformed by squeezing to eject fluid from aperture 40, through passage 9 and out of apertures 10 in second treatment surface 16.

Tube 37 may be permanently deformable or resiliently deformable depending on requirements, and such is not essential to the invention.

Where in the foregoing description reference has been made to integers or elements have known equivalents then such are included as it individually set forth herein.

Embodiments of the invention have been described, however it is understood that variations, improvement or modifications can take place without departure from the spirit of the invention or scope of the appended claims.

What I claim is:

1. A hair treatment applicator head including:

a first elongate body member having a handle portion at a first end and a first treatment surface proximate a second end, the treatment surface bearing a fluid absorbent material, and a second elongate body member having a flange for engagement with a treatment fluid supply at a first end and a second treatment surface proximate a second end, and a fluid path extending through the body from proximate the flange to a plurality of apertures on the second treatment surface, the first and second elements hingeably engaged to allow the first and second treatment surfaces to be brought into proximity of each other wherein the first treatment surface is removably engaged to the second end of the first elongate body member, and the fluid absorbent material is removably attached to the first treatment surface.

2. A hair treatment applicator as claimed in claim 1 wherein the second elongate body has a plurality of teeth adjacent the second treatment surface.

3. A hair treatment applicator including:

an elongate housing, a tubular element removably located within the housing and serving as a reservoir for hair treatment fluid, a pumping member located at the first end of the housing and in communication with a first end of the tubular element, and a hair dye applicator head located at the second end of the housing and in communication a second end of the tubular element, the applicator head including:

a first elongate body member having a handle portion at a first end and a first treatment surface proximate a second end, the treatment surface bearing a fluid absorbent material, a second elongate body member having a flange for engagement with the elongate housing at a first end and a second treatment surface proximate a second end, and a fluid path in fluid communication with the second end of the tubular element and extending through the body to a plurality of apertures on the second treatment surface, the first and second elements hingeably engaged to allow the first and second treatment surfaces to be brought into proximity each other.

4. A hair treatment applicator as claimed in claim 3 wherein the fluid absorbent material is removably attached to the first treatment surface.

5. A hair treatment applicator as claimed in claim 3 wherein the first treatment surface is removably engaged to the second end of the first elongate body member, and the fluid absorbent material is removably attached to the first treatment surface.

6. A hair treatment applicator as claimed in claim 3 wherein the second elongate body has a plurality of teeth adjacent the second treatment surface.

7. A hair treatment applicator as claimed in claim 3 wherein the tubular element has a worm drive longitudinally therethrough and a plunger disposed on the worm drive, the pumping element being a motor adapted to turn the worm drive and cause the plunger to eject treatment fluid from the second end of the tubular element.

8. A hair treatment applicator including:

a deformable container closed at a first end and having a neck portion at a second end, the neck portion having an aperture therein providing a fluid path to the interior of the container, and a hair dye applicator head including:

a first elongate body member having a handle portion at a first end and a first treatment surface proximate a second end, the treatment surface bearing a fluid absorbent material, a second elongate body member having a flange for engagement with the neck portion at a first end, a second treatment surface proximate a second end, and a passage extending through the body from the flange to a plurality of apertures on the second treatment surface, the first and second elements hingeably engaged to allow the first and second treatment surfaces to be brought into proximity each other.

* * * * *